US009871306B2

(12) United States Patent
Mizusawa

(10) Patent No.: US 9,871,306 B2
(45) Date of Patent: Jan. 16, 2018

(54) ELECTRICAL CONNECTOR FOR A FLAT CONDUCTOR

(71) Applicant: Hirose Electric Co., Ltd., Tokyo (JP)

(72) Inventor: Shoichi Mizusawa, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 15/455,042

(22) Filed: Mar. 9, 2017

(65) Prior Publication Data

US 2017/0264028 A1 Sep. 14, 2017

(30) Foreign Application Priority Data

Mar. 10, 2016 (JP) ..... 2016-046813

(51) Int. Cl.
*H01R 4/50* (2006.01)
*H01R 4/26* (2006.01)
*H01R 12/72* (2011.01)

(52) U.S. Cl.
CPC ..... *H01R 4/5008* (2013.01); *H01R 4/26* (2013.01); *H01R 12/721* (2013.01)

(58) Field of Classification Search
CPC H01R 11/30; H01R 13/6205; H01R 13/6581; H01R 2107/00; H01R 43/20; H01R 12/88; H01R 13/22; H01R 24/66; H01R 43/26; H01R 12/79; H01R 12/58; H01R 12/62; H01R 12/7076; H01R 12/714; H01R 12/77
See application file for complete search history.

(56) References Cited

U.S. PATENT DOCUMENTS 5,674,085 A * 10/1997 Davis ..... H01R 13/7031 200/51.1
7,798,832 B2 * 9/2010 Qin ..... H01R 12/712 439/188
2007/0077809 A1 * 4/2007 Takashita ..... H01R 13/629 439/492
2010/0184317 A1 * 7/2010 Sunaga ..... H01R 12/57 439/260
2011/0244709 A1 * 10/2011 Ashibu ..... H01R 12/774 439/372
2014/0242846 A1 * 8/2014 Miki ..... H01R 12/79 439/630
2015/0311640 A1 * 10/2015 Kurachi ..... H01R 12/775 439/607.31

* cited by examiner

*Primary Examiner* — Truc Nguyen
(74) *Attorney, Agent, or Firm* — Procopio, Cory, Hargreaves & Savitch LLP

(57) ABSTRACT

An object is to provide an electrical connector for a flat conductor that does not leave behind plastic deformation on a pressing arm part of a terminal pressing a flat conductor. A metal plate terminal, housing, and movable member are provided, where the terminal has a pressing arm part extending such that an insertion-and-removal direction of a flat conductor is in a longitudinal direction, and a supporting arm part extending in the longitudinal direction, which is connected with the pressing arm part by a connecting part. The pressing arm part has a pressing part for pressing one surface of the flat conductor on a rear end side which is an insertion side of the flat conductor, and a pressure receiving part receiving a force from a cam part on a position more forward than the pressing part.

6 Claims, 8 Drawing Sheets

ELECTRICAL CONNECTOR FOR A FLAT CONDUCTOR

This application claims priority under 35 USC §119 of Japanese Patent Application No. 2016-046813, filed on Mar. 10, 2016, the contents of which is incorporated by reference in its entirety.

BACKGROUND

Technical Field

The present invention relates to an electrical connector for a flat conductor.

Background Art

Flexible printed circuits (FPC), flat cables, and the like are flat conductors. Flat conductors are often connected to an electrical connector attached to a circuit board. A connector disclosed in Patent Document 1, for example, is known as a flat conductor for an electrical connector to be connected to a flat conductor.

Terminals made of metal plate in the connector of Patent Document 1 maintain a flat plate surface of the metal plate and a plurality of the terminals are arranged at intervals in the orthogonal direction of the plate thickness, and held by a housing. In Patent Document 1, two types of terminals are mixed and arranged, both types of terminals have an upper pressing arm part and a lower supporting arm part that are almost parallel to each other, and both arm parts are connected by a connecting part at the middle part in the longitudinal direction. Each terminal is inserted and contained in a terminal groove formed to penetrate on the right and left an opposing inner surface of an upper wall and a bottom wall of the housing. The pressing arm part is contained in the terminal groove on the upper wall side, and the supporting arm part is contained in the terminal groove on a lower wall side. With the supporting arm part of one type of terminal, a right end side portion is more fixed and held by the bottom wall of the housing than by a connecting portion, and with the supporting arm part of the other type of terminal, a left end side portion is fixed and held by the bottom wall of the housing. A receiving part that is formed so that a space receiving the flat conductor is linked with the aforementioned plurality of terminal ends is formed between the upper wall and the lower wall of the housing.

In the Patent Document 1 with this type of terminal, a movable member rotatably supported from an open position to a closed position is provided, the flat conductor is inserted from a back end side in the longitudinal direction into the aforementioned receiving part between the pressing arm part and the supporting arm part when the movable member is in the open position, the movable member having a cam positioned between both arm parts at a front end side is rotated to the closed position and the front end side of the aforementioned pressing arm part is pressed by the cam, and the back end side of the pressing arm part is elastically displaced to the supporting arm part side by the principle of leverage to press the flat conductor to the supporting arm part.

When the movable member is rotated from the open position to the closed position, the supporting arm part of the two types of terminals that is pressed to the flat conductor can be elastically displaced (deflected) in a range from the position of the connected portion to the position of the protruding supporting part provided on the upper edge of the back end side of the supporting arm part.

Therefore, the flat conductor is positioned between the pressing arm part and the supporting arm part of the two types of terminals, and pressed by the pressing part to have contact pressure with the supporting part to be electrically connected.

PRIOR ART DOCUMENTS

Patent Document

Patent document 1: Japanese Unexamined Patent Application 2014-212007

SUMMARY

Problems to be Solved by the Invention

With the connector of Patent Document 1, the rotary movement operation of the movable member is possible even when the flat conductor is not inserted in the receiving part. When the flat conductor is not inserted, the flat conductor, which is meant to be the object which the pressing part of the pressing arm part presses, is in an absent state, and if the movable member is inadvertently moved to the closed position, the pressing part greatly exceeds the pressing state for the normal flat conductor and the pressing member is displaced to a position with maximum elastic displacement. This results in an unnecessary elastic displacement, and if movement that generates the maximum elastic displacement is repeated, plastic deformation remains in the pressing arm part even in a free state after the movement is canceled, and the pressing member will be at a closer position than the initial position to the supporting part of the supporting arm part. In other words, the interval between the pressing part and the supporting part is narrowed. This makes inserting the flat conductor during use difficult, and if the aforementioned interval exceeds an allowable value and becomes small, the front end of the flat conductor impacts forward against the back end of the pressing arm part and applies an impact force. The impact force acts in the longitudinal direction of the pressing arm part, and therefore, buckling may occur in the pressing arm part, and this greatly interferes with the connection of the connector of the flat conductor.

In light of the foregoing, an object of the present invention is to provide an electrical connector for a flat conductor wherein even if the movable member is operated toward a closed position when the flat conductor is not inserted, elastic deformation will not occur to an extent that causes plastic deformation in a pressing arm part, buckling in the pressing arm part will not occur, protection of the pressing arm part and a predetermined elastic displacement of the pressing arm part can be ensured, and the flat conductor can be inserted smoothly into a receiving part at any time.

Means for Solving the Problems

An electrical connector for a flat conductor according to the present invention comprises: a metal plate terminal; a housing holding the terminal at a predetermined interval in a direction orthogonal to a plate surface thereof; and a movable member that can be moved between an open position that enables insertion of a flat conductor facing frontward toward a receiving part formed on the housing and a closed position that presses the flat conductor at the terminal, wherein the terminal has a pressing arm part extending such that an insertion-and-removal direction of the flat conductor is in a longitudinal direction, and a supporting arm part connected to the pressing arm part by a connecting part that extends in the longitudinal direction; the pressing arm part has a pressing part for pressing one surface of the flat conductor on a rear end side which is an insertion side of the flat conductor, and a pressure receiving part that receives a force from a cam part at a more forward position than the pressing part; the pressing arm part receives a force from the cam part, and the pressing arm part causes elastic displacement inside the same surface as the terminal plate surface, such that the flat conductor is pressed by a pressing part.

In the present invention, a regulating means that regulates elastic displacement on a more rear end side than a connecting part of the pressing arm part is provided on at least one of the terminal pressing arm part and the housing or a member attached to the housing, in the electrical connector for a flat conductor.

If a flat conductor is not inserted, when the movable member is moved toward a closed position, the pressing arm part will be regulated such that the elastic displacement is not further increased by the regulating means during movement, and therefore, the elastic displacement further to the rear end side than the pressing arm part will not be higher than a predetermined amount. The predetermined amount is ensured so as to be a sufficient amount for pressing a flat conductor when inserting the flat conductor, and even if the flat conductor is not inserted, the pressing arm part is not excessively elastically displaced. Therefore, plastic deformation does not occur on the pressing arm part, and an interval between the pressing part and supporting part will not be narrower than an initial predetermined amount. As a result, smooth insertion of the flat conductor is assured and buckling of the pressing arm part due to impact with the pressing arm part is prevented or minimized in order to protect the pressing arm part.

In the present invention, the regulating means can be provided at a position where the elastic displacement of the pressing arm part due to movement of the movable member when the flat conductor is not inserted is smaller than the maximum elastic displacement of the pressing part when the movable member is provided at a closed position if regulation is not received by the regulating means, and is larger than the elastic displacement at a contact start position with the flat conductor of the pressing part when the movable member during insertion into the receiving part of the flat conductor is moving toward a closed position. With this aspect, the regulating value of the elastic displacement by the regulating means is smaller than the maximum elastic displacement caused by the pressing arm part when a flat conductor is not inserted, and is larger than the elastic displacement when starting contact with the pressing part on the flat conductor during insertion, and therefore, plastic deformation on the pressing arm part does not occur even if the movable member is inadvertently moved to an open position when the flat conductor is not inserted, while also maintaining a state in which the flat conductor inserted during connector use can be sufficiently pressed.

In the present invention, the regulating means is sufficient so long as the regulating part formed on the housing or a member attached thereto and the regulated part formed on a portion of the pressing arm part are provided, and there are no restrictions to the position or shape of the regulating part or regulated part.

In the present invention, as one aspect, the regulating means can have the regulated part positioned on a same surface as the plate surface and formed as a rear end protruding part protruding more rearward than the pressing part of the pressing arm part, and the regulating part formed as a rear end receiving part protruding frontward to a position below the rear end protruding part of the pressing arm part at a rear end of the housing; as another aspect, the regulating means can have the regulated part formed as a lateral protruding part that bends laterally and is more rearward from the plate surface of the terminal to the pressing part, and the regulating part formed as a lateral receiving part positioned below a lateral protruding part of the pressing arm part at a rear end of the housing; and as yet another aspect, the regulating means can have the regulated part formed at a lower edge of the pressing arm part at an intermediate position near the connecting part in the longitudinal direction of the pressing arm part, and can have the regulating part protruding laterally to below the regulated part at a lateral position of the terminal and formed as an intermediate receiving part receiving the regulating part.

Any aspect can be appropriately selected based on the design conditions of the terminal itself and design conditions in relation to the housing.

Effects of the Invention

As described above for the present invention, if a flat conductor is not inserted, even when the movable member is moved toward a closed position, the pressing arm part will be regulated by the regulating means such that the elastic displacement on a more rear end side than the connecting part is not increased more than a predetermined amount, and therefore, excessive elastic displacement does not occur and plastic deformation does not occur. As a result, even if opening and closing of the movable member is repeated, the interval between the supporting part and pressing part when a flat conductor is not inserted is maintained at a constant interval or more without becoming narrow, the flat conductor always performs smoothly during use, and, since a predetermined amount of elastic displacement is reliably provided, buckling does not occur due to a front end of the flat conductor impacting a rear end of the pressing arm part, which leads to protection of the terminal.

BRIEF DESCRIPTION OF THE DRAWINGS

FIGS. 4(A) and 4(B) illustrate a state in which the movable member is in an open position and closed position, respectively, when a flat conductor is not inserted, and FIG. 4(C) illustrates a state in which a flat conductor is in a closed position when the flat conductor is inserted.

FIG. 7(A) illustrates a side surface cross-sectional view and partial front surface cross-sectional view where the movable member is in an open position when a flat conductor is not inserted, FIG. 7(B) illustrates a side surface cross-sectional view and partial front surface cross-sectional view where the movable member is in a closed position when a flat conductor is not inserted, and FIG. 7(C) illustrates a side surface cross-sectional view and partial front surface cross-sectional view where the movable member is in a closed position when a flat conductor is inserted.

FIGS. 8(A) and 8(B) illustrate a state in which the movable member is in an open position and closed position, respectively, when a flat conductor is not inserted, and FIG. 8(C) illustrates a state in which a flat conductor is in a closed position when the flat conductor is inserted.

DETAILED DESCRIPTION

Embodiments of the present invention are described below based on the accompanying drawings.

First Embodiment

Figure 1:
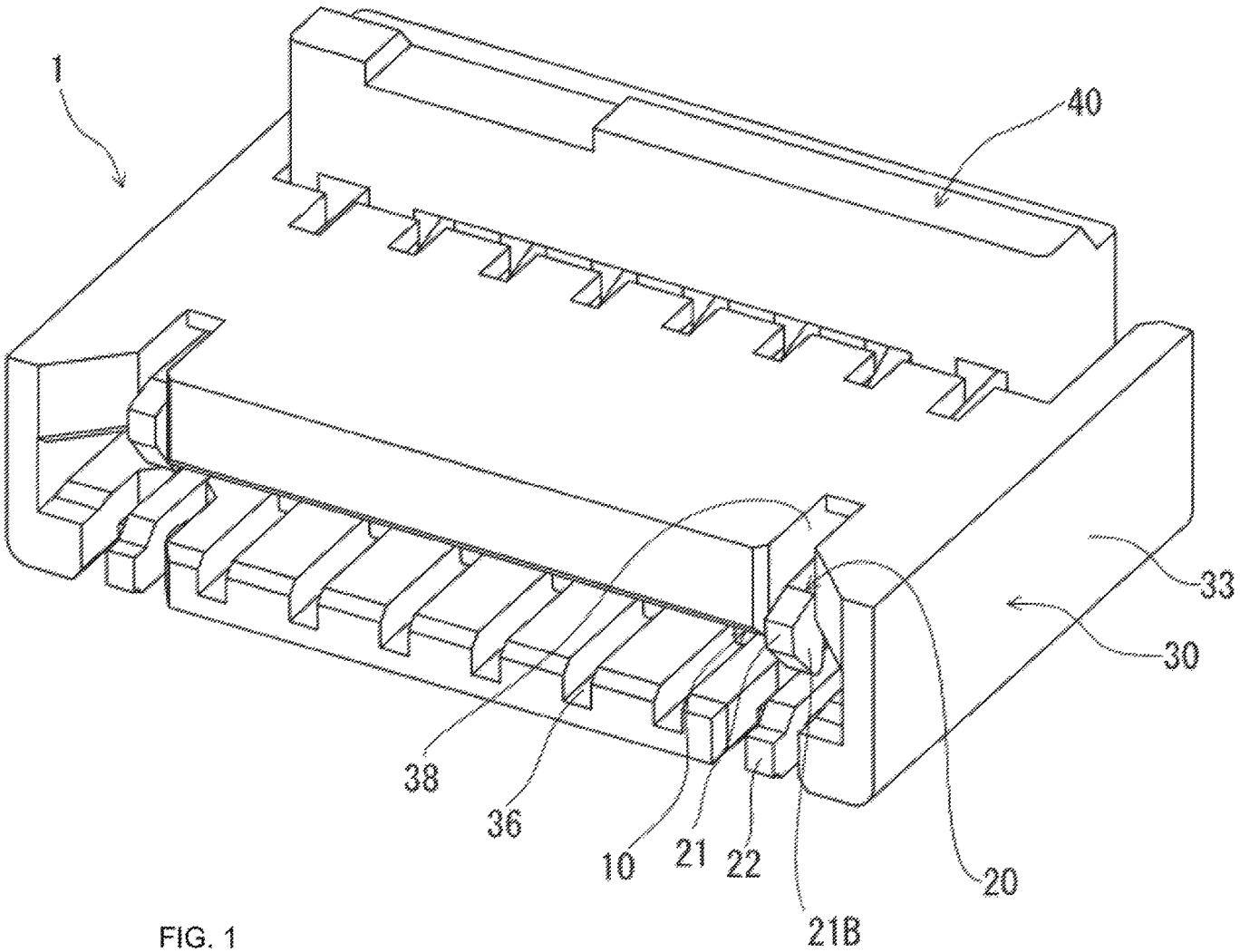
FIG. 1 illustrates an overall perspective view of a connector of a first embodiment of the present invention when a flat conductor is not inserted, which illustrates a state in which a movable member is provided in an open position.
Figure 2:
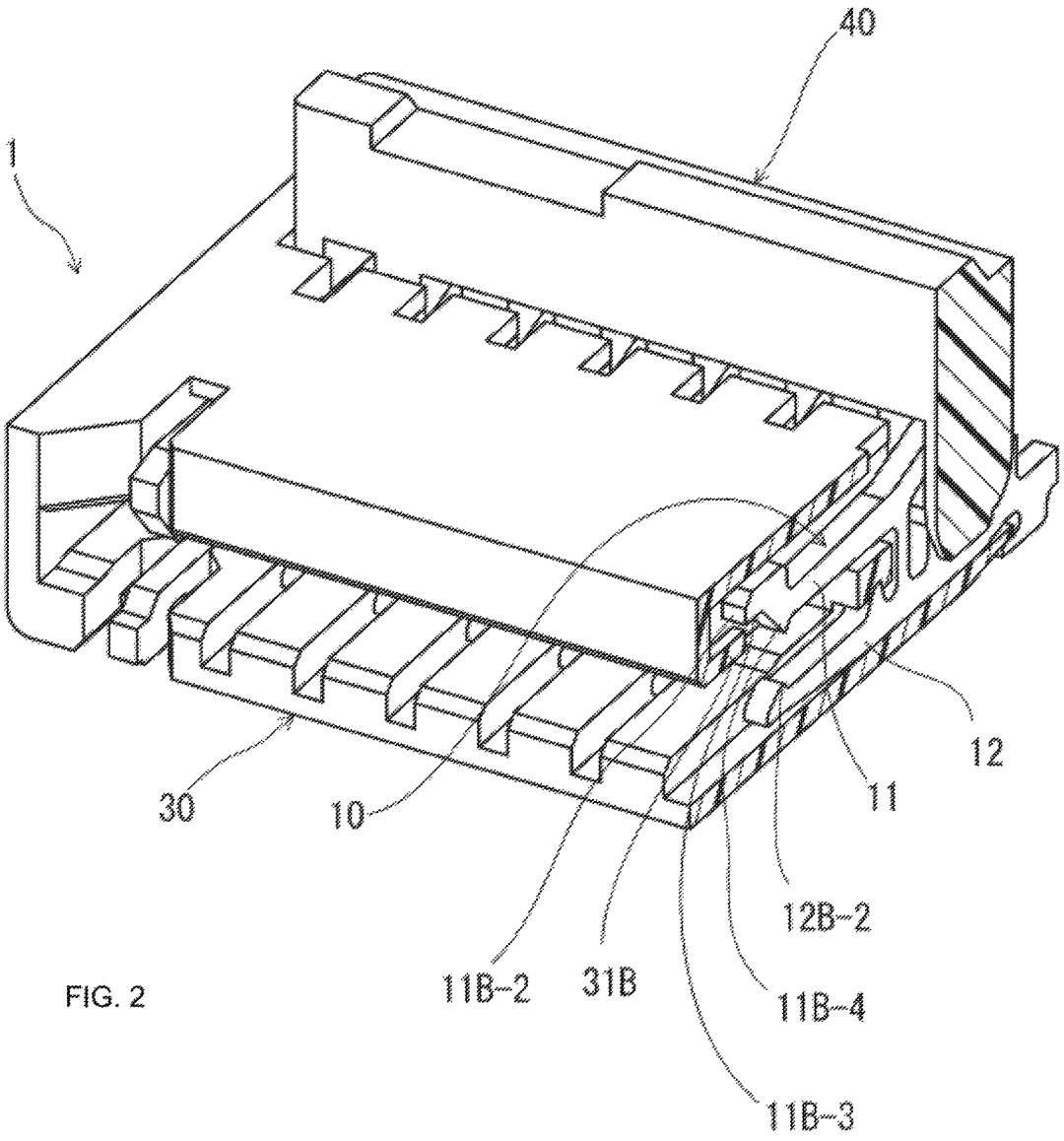
FIG. 2 illustrates a cross-sectional perspective view where the movable member is in an open position, where the cross-section is taken at a terminal position of the connector in FIG. 1.
Figure 3:
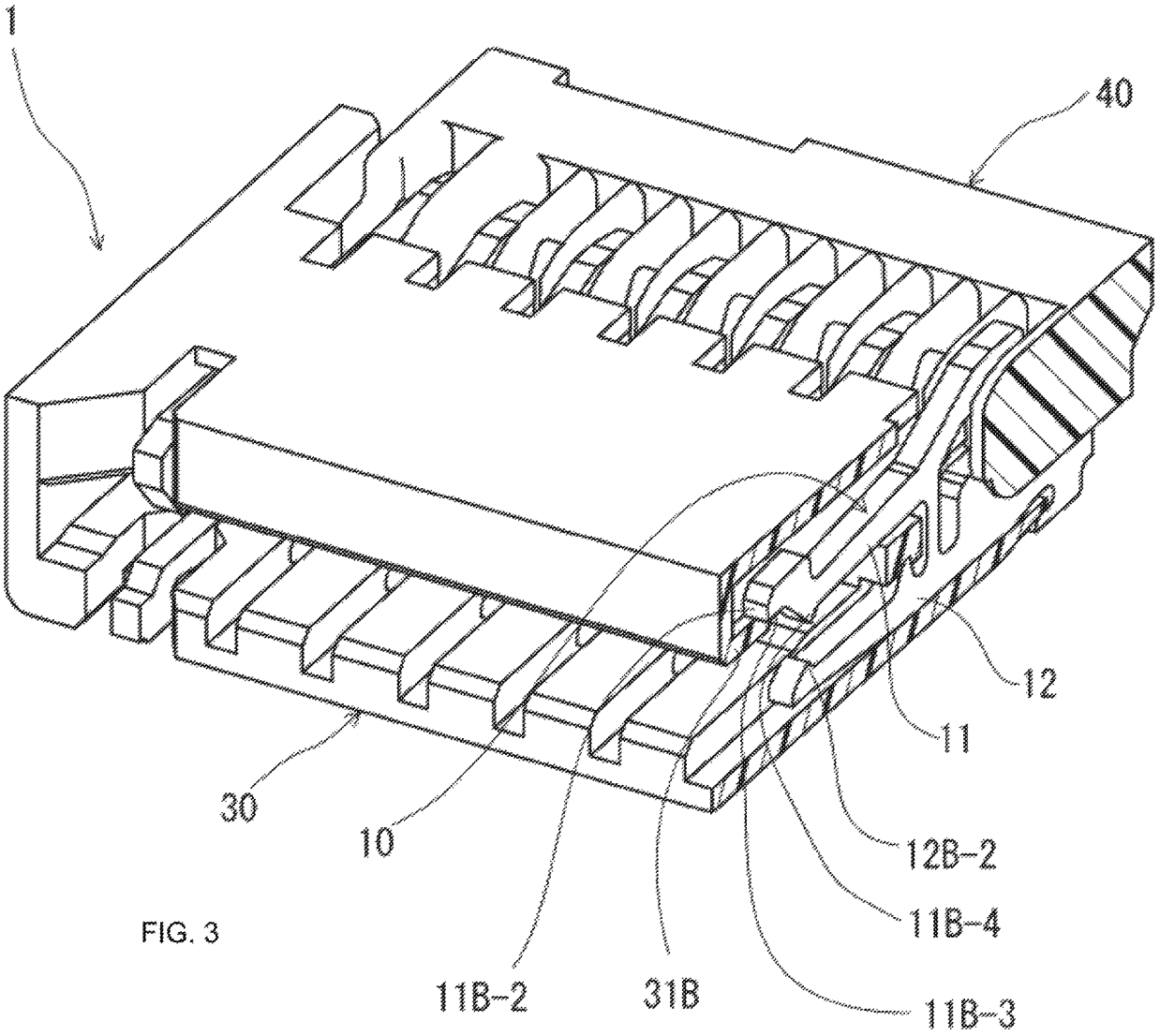
FIG. 3 illustrates a cross-sectional perspective view of the connector in FIG. 1 at a terminal position when a flat conductor is not inserted, which illustrates a state in which the movable member is in a closed position.

FIG. 1 is an overall perspective view of a connector of the present embodiment, which illustrates a state in which the movable member is in an open position when a flat conductor is not inserted (before inserting). FIG. 2 is a perspective view taken along a terminal position of the connector in FIG. 1. FIG. 3 is a perspective view when the movable member is in a closed position in the connector in FIG. 2. Furthermore, FIGS. 4(A) to 4(C) are cross-sectional views illustrating a cross section in various states.

In FIG. 1 through FIG. 3, a connector 1 has a metal plate terminal 10, a metal fitting 20, a housing 30 for retaining the terminal 10 and metal fitting, and a movable member 40 that can rotate and move with regard to the housing 30.

Figure 4A:
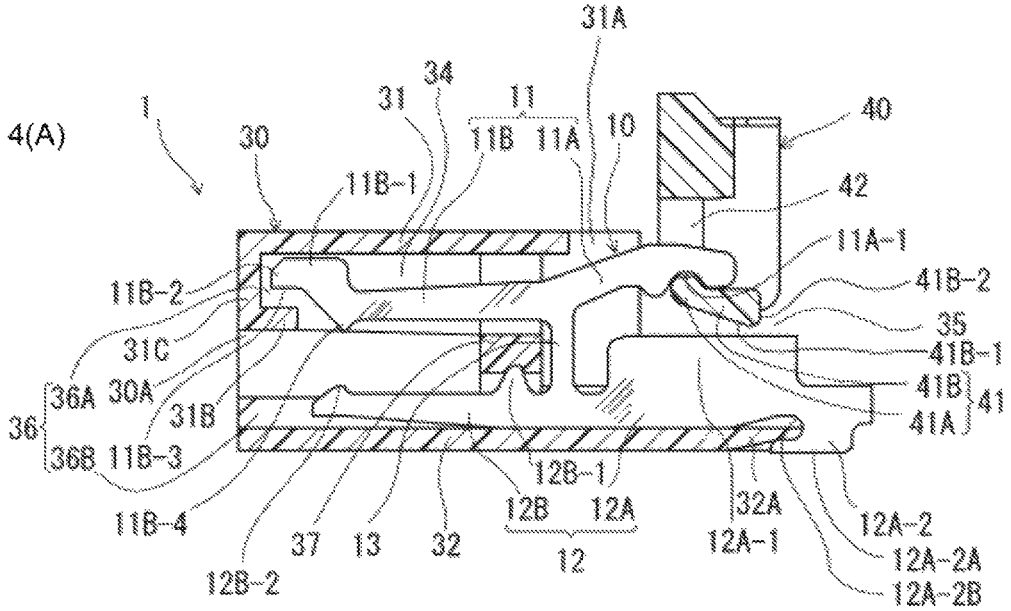
FIGS. 4(A) to 4(C) illustrate cross-sectional views of the connector in FIG. 1 in a terminal position, where
Figure 4B:
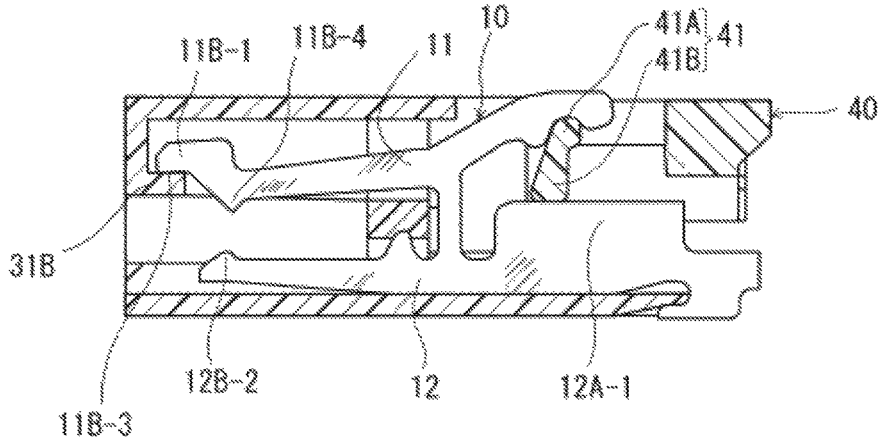
Figure 4C:
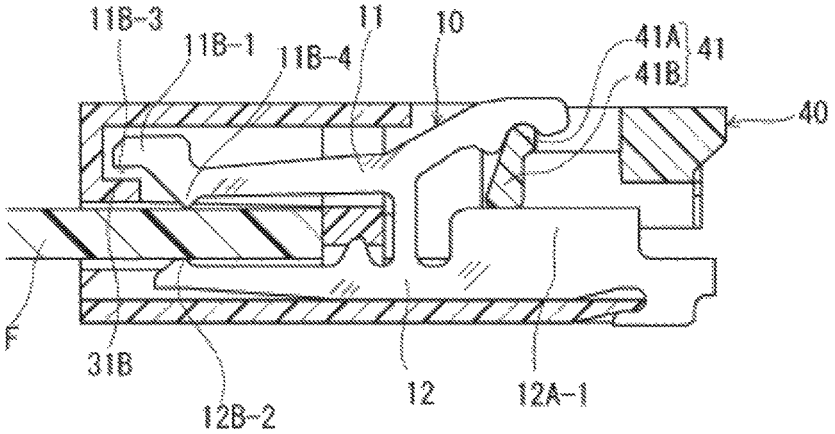

The terminal 10 maintains a flat surface of a metal plate, forms a plate surface parallel to a paper surface as seen in FIG. 4(A) illustrating a state in which the movable member 40 is in an open position, and has a pressing arm part 11 extending in a lateral direction (left and right direction of the paper surface) at an upper position, a supporting arm part 12 extending in the lateral direction similar to the pressing arm part 11 at a lower position, and a connecting part 13 connecting both at an intermediate position thereof.

The pressing arm part 11 has an upper front arm part 11A of a portion more forward (right side in the drawing) than the connecting part 13, and an upper rear arm part 11B of a portion more rearward (left side in the drawing) than the connecting part 13. After the upper front arm part 11A is tilted upward toward a position more forward than an upper end position of the connecting part 13, it is extended forward substantially as is, and thus a concave pressure receiving part 11A-1 is formed on a lower edge at a position near a front end of the upper front arm part 11A. In contrast, the upper rear arm part 11B forms an upper bulging part 11B-1 where a rear end portion thereof is raised upward, the rear end (left end) has a rear end protruding part 11B-2 protruding rearward with an upper edge as a tapered part and a lower edge as a horizontal part, and thus the lower edge is formed as a regulated part 11B-3 for contacting a regulating part 31B described later. The upper bulging part 11B-1 has a pressing part 11B-4 protruding downward forming an essentially triangular shape at a frontward position adjacent to the regulated part 11B-3 at a lower edge thereof.

The pressing arm part 11 has elasticity and a relatively small width (upper and lower direction width) in the vicinity of the connecting part 13, and elastic displacement is possible so as to be tilted in the form of a lever with the connecting part 13 as a fulcrum.

The supporting arm part 12, provided in parallel facing the pressing arm part 11 below the pressing arm part 11, has a lower front arm part 12A of a portion more frontward than the connecting part 13 and a lower rear arm part 12B of a portion more rearward than the connecting part 13. The lower front arm part 12A has a cam supporting part 12A-1 rising from an immediately forward position with regard to the connecting part 13, and protruding in a trapezoidal shape extending forward, and a connecting part 12A-2 protruding forward at a lower portion of a front end position of the cam supporting part 12A-1. The cam supporting part 12A-1 is positioned below the pressure receiving part 11A-1 formed on the upper front arm part 11A of the pressing arm part 11, opposes the pressure receiving part 11A-1, and extends in a straight form forward and rearward including the opposing position thereof. Furthermore, the connecting part 12A-2 has a lower edge positioned at a level protruding slightly below or at the same level as a bottom surface of the housing 30 described later, and a surface of the lower edge is solder connected to a circuit member (not illustrated in the drawing) to form a solder connecting surface 12A-2A. The connecting part 12A-2 has a securing groove 12A-2B forming a curved groove formed on a rear edge thereof, and functions for securing and attaching to the housing 30 such that the securing groove 12A-2B mates to a front end securing part 32A provided on the housing 30. Note that a right end flange of the connecting part 12A-2 is an edge part separated from a carrier in order to form a completed product from a semi-completed product state where a terminal is connected to a carrier (not illustrated in the drawing).

The lower rear arm part 12B of the supporting arm part 12 extends rearward from a position of the connecting part 13, which reaches a position slightly more in front of the regulated part 11B-3 of the pressing arm part 11, in other words, a position slightly more forward than the regulated part 11B-3 in a front and rear direction. A locking protrusion 12B-1 that protrudes upward so as to bite into an intermediate securing part 37, which is provided on the housing and will be described later, is provided on the lower rear arm part 12B in a directly rearward position to the connecting part 13, and a supporting part 12B-2 that protrudes upward, in a vertical direction opposing the pressing part 11B-4 of the pressing arm part 11 in the front and rear direction, is provided on a rear end. An interval between the supporting part 12B-2 and pressing part 11B-4 is set to have a wider thickness dimension than the thickness dimension of a flat conductor F when the terminal 10 is in a free state, in other words, when the flat conductor F (refer to FIG. 4(C)) is not inserted.

A plurality of the terminals 10 formed thereby are retained by the housing 30 at predetermined intervals in a connector width direction which is the lateral direction sloping down toward the right in FIG. 1 through FIG. 3 (a direction orthogonal to the paper surface in the views of FIGS. 4(A) to 4(C)).

The housing 30, which retains the terminals 10 and is made of an electrical insulating material, has an upper wall 31 and lower wall 32 that span a wider range than that of the terminal array, a side wall 33 (refer to FIG. 1) that holds the upper wall 31 and lower wall 32 on both ends in the connector width direction, and a partition wall 34 that connects the upper wall 31 and lower wall 32 at a predetermined interval between two side walls 33, and thus forms a flat essentially cuboid outer shape.

The upper wall 31 has formed therein a notched part 31A, which is open frontward in a wide range such that the front portion extends beyond the range of the terminal array in the connector width direction to a position in the vicinity of the side wall 33. In other words, the notched part 31A is also opened upward. The partition wall 34 is also cut off and the housing 30 forms a front opening part 35 in the connector width direction range where the notched part 31A is formed. The front opening part 35 functions as a rotating space and arrangement for the movable member 40 described later.

A terminal groove 36 extending from the front opening part 35 to the housing 30 in the front and rear direction is formed on the housing 30. A plurality of the terminal grooves 36 are provided at a predetermined arrangement position of the terminal 10, and one terminal groove 36 is configured by forming as a pair an upper groove 36A formed on a lower surface of the upper wall 31 and a lower groove 36B formed on an upper surface of the lower wall 32 opposite therefrom. In other words, the partition wall 34 is formed between adjacent terminal grooves 36 in the connector width direction.

Provided on each terminal 36, at a position corresponding to the previously described locking protrusion 12B-1 of the terminal 10 in the front and rear direction, is an island-shaped intermediate securing part 37 that connects the partition walls 34 on both sides of the terminal groove 36, and which is positioned between the lower rear arm part 12B of the supporting arm part 12 and the upper rear arm part 11B of the pressing arm part 11 of the terminal 10 in the vertical direction.

The housing 30 has the receiving part 30A that is opened rearward on a rear part (left part of FIGS. 4(A) to 4(C)) for inserting a flat conductor, which is formed between the upper wall 31 and lower wall 32 in the vertical direction. The receiving part 30A extends in a direction orthogonal to the paper surface in the same drawing so as to penetrate the partition wall 34, and is connected with a plurality of the terminal grooves 36.

The upper wall 31 has a hook wall part 31C formed into a lateral U-shape hanging downward and then protruding frontward at a rear end thereof, and the wall part protruding frontward at a lower end of the hook wall part 31C forms the regulating part 31B as a rear end receiving part with regard to the pressing arm part 11 of the terminal 10. The regulating part 31B is positioned immediately below the regulated part 11B-3 provided on a rear end of the terminal 10, and regulates the elastic displacement of the regulated part 11B-3 to a predetermined amount.

The lower wall 32 of the housing 30 extends in the front and rear direction to form a flat plate shape essentially parallel to the upper wall 31, and a front end of the lower wall 32 extends to the vicinity of a front end of the housing 30 and to a rear end of the housing 30 of a rear end of the lower wall 32. The lower wall 32 has a portion positioned below the front opening part 35 of the housing 30 more forward than a front end of the upper wall 31, and in the rear direction, a rear end of the lower wall 32 is positioned to match the rear end of the upper wall 31 in the front and rear direction. A front end (right end) of the lower wall 32 has a lower surface formed in a tapered shape, which forms the tapered front end securing part 32A. The front end securing part 32A is pressed inside the securing groove 12A-2B of the terminal 10 to secure the terminal 10.

Accordingly, the housing 30, which retains the terminals 10, also holds a metal fitting 20 on both sides beyond the range of the terminal array, as seen in FIG. 1. The metal fitting 20 has a locking part 21B that protrudes and locks into an engaging part (not illustrated in the drawing) with a notched groove shape formed on the flat conductor, and prevents the flat conductor from disengaging after insertion. The metal fitting 20 has essentially the same overall shape as the terminal described above, and when the movable member 40 described later is moved to a closed position, the upper arm part 21 corresponding to the pressing arm part 11 of the terminal 10 is elastically displaced. However, a point of difference with the terminal 10 is, with the metal fitting 20, the locking part 21B does not contact the flat conductor at this time, but protrudes into the engaging part formed as a notched part of the flat conductor, as compared to the pressing part 11B-4 of the terminal 10 that contacts the surface of the flat conductor.

The shape of a rear end side of the metal fitting 20 having this point of difference will now be described.

The metal fitting 20 has a protruding locking part 21B with a larger size than the pressing part 11B-4 of the pressing arm part 11 in a shape resembling the pressing part 11B-4 (refer to FIG. 1) that is formed on a rear end of the upper arm part 21 corresponding to the pressing arm part 11 of the terminal at a slightly more rearward position than a rear end of the pressing arm part 11, and a lower arm part 22 extends to a position at the rear end of the housing 30, so as to constitute a straight form up to a position in the vicinity of the rear end of the lower arm part 22. The metal fitting 20 is not a feature of the present invention, and therefore, a further description of the metal fitting 20 is omitted.

Rear end sides of the terminal 10 and metal fitting 20 formed thereby are positioned on a front opening part 35 of the housing 30, and then faced rearward and pressed into a terminal groove 36 and a metal fitting groove (not illustrated in the drawing), and, in the case of the terminal 10, the locking protrusion 12B-1 provided on a lower rear arm part 12B bites into the intermediate securing part 37 of the housing 30, and the front end securing part 32A of the housing 30 is pressed into a securing groove 12A-2B formed on a lower front arm part 12A, the terminal 10 is inserted into the terminal groove 36 to a predetermined position, thereby allowing for the retention of that position as well as preventing disengagement. The metal fitting 20 is also pressed into a metal fitting groove similar to the terminal 10, and thus disengagement can be prevented at a predetermined position. Note that a slit-shaped clearance groove 38 is formed on the housing 30 in order to enable increasing the elastic displacement upward on a rear end of the upper arm part 21 of the metal fitting 20 (refer to FIG. 1).

The pressure receiving part 11A-1 formed on a front end part of the terminal 10 as described above, and the movable member 40 that is rotatably supported on a pressure receiving part (not illustrated in the drawing), is similar to the metal fitting 20 and exerts an upward force on the pressure receiving part 11A-1, have a cam part 41 stored in the pressure receiving part 11A-1 as seen in FIG. 4(A). In the same figure, the movable member 40 is formed as a plateshaped member extending in a direction orthogonal to a paper surface, and is rotatable around the cam part 41 between an open position illustrated in the same drawing and a closed position illustrated in FIGS. 4(B) and (C).

The movable member 40 is formed as a plate member extending in a direction orthogonal to the paper surface in FIG. 4(A) over the entire width of the front opening part 35 of the housing 30 in the connector width direction, and is rotatably supported by the metal fitting 20 and terminal 10 between an open position in FIG. 1, FIG. 2, and FIG. 4 and a closed position in FIGS. 4(B) and (C) (a state of being supported by the metal fitting 20 is not illustrated).

The movable member 40 has a groove part 42 that stores a rear end part in the vicinity of the pressure receiving part 11A-1 of the terminal and a rear end part in the vicinity of the pressure receiving part of the metal fitting 20 in a lower half in an upright state at an open position in FIG. 4(A), the cam part 41 is provided on a lower end of the movable member in the groove part 42. The cam part connects grooved inner walls located on both sides of the groove part 42 in the connector width direction.

The cam part 41 has a rotating axis part 41A with a curved surface suitable for rotating in the concave pressure receiving part 11A-1 formed on the terminal 10, and a supported part 41B forming an essentially trapezoidal cross section that is long in the lateral direction, protruding and extending laterally from the rotating axis part 41A in FIG. 4(A). A lower edge of the supported part 41B forms a straight edge part 41B-1 with a downward slope toward a rightward direction and a right end forms an edge part 41B-2 extending vertically. For the edge part 41B-2, the cam part 41 rotates in a clockwise direction around the rotating axis part 41A from an open position in FIG. 4(A), and when in a closed position in FIGS. 4(B) and (C), the edge part 41B-2 will go above a cam supporting part 12A-1 of the terminal 10. The length in the lateral direction of the cam part 41 in an open position state in FIG. 4(A) is longer than an interval between a groove bottom of the pressure receiving part 11A-1 in the same drawing and an upper edge of the cam supporting part 12A-1, and when the cam part 41 is in a closed state in FIGS. 4(B) and (C), the cam part 41 transmits a reaction force from the cam supporting part 12A-1 to the pressure receiving part 11A-1, elastically displaces the upper front arm part 11A of the terminal 10 upward, and widens the interval such that an upright state is achieved. Thus, when the upper front arm part 11A of the terminal 10 is elastically displaced upward, the pressing arm part 11 is displaced in a lever shape with the connecting part 13 as a fulcrum, and thus the upper rear arm part 11B is elastically displaced downward, the pressing part 11B-4 in the vicinity of a rear end thereof moves downward, and the flat conductor F is pressed downward.

Principles of operation and outlines for use of the connector in the present embodiment are described below based on FIGS. 4(A) to 4(C) of the accompany drawings.

As seen in FIG. 4(A), when a flat conductor is not inserted (before inserting) into the connector 1, the terminal 10 is in a free state not elastically displaced between the pressing part 11B-4 of the pressing arm part 11 of the terminal 10 and the supporting part 12B-2 of the supporting arm part 12, and therefore, a large interval is maintained and a flat conductor (not illustrated in the drawing) is in a state than can be easily inserted into the receiving part 30A from the left. In this state, the regulated part 11B-3 of the terminal 10 is in a state located above and not contacting the regulating part 31B of the housing 30.

Next, if the movable member 40 is moved into a closed position inadvertently or in order to store the connector 1 when a flat conductor is not inserted, the cam part 41 of the movable member 40 achieves an upright state, the pressure receiving part 11A-1 of the pressing arm part 11 receives a force directed upward from the cam part 41, and the upper front arm part 11A of the pressing arm part 11 causes elastic displacement such that a front end thereof is raised. The elastic displacement of the upper front arm part 11A is an elastic displacement directed downward based on a lever principle with a position of the connecting part 13 as a fulcrum with regard to the upper rear arm part 11B. However, in the present embodiment, the regulated part 11B-3 is provided on the terminal 10 and the regulating part 31B is provided on the housing 30 so as to be positioned mutually opposing in the vertical direction, and therefore, as seen in FIG. 4(B), while the movable member 40 moves to a closed position, the regulated part 11B-3 contacts the regulating part 31B, and in a state in which the upper rear arm part 11B of the pressing arm part 11 is not elastically displaced any further, the movable member 40 reaches a closed position and only the elastic displacement of the upper front arm part 11A is increased.

Therefore, even if the movable member 40 receives a movement operation to a closed position when a flat conductor is not inserted, the upper rear arm part 11B of the pressing arm part 11 is regulated midway and does not cause excess elastic displacement, and therefore, when returning to an open position, plastic deformation does not remain as in conventional techniques, and an interval between the pressing part 11B-4 of the terminal 10 and supporting part 12B-2 is not narrowed by plastic deformation but is maintained at a predetermined amount or more. Therefore, when a flat conductor is inserted, the flat conductor can always be smoothly inserted in the receiving part 30A.

When using the connector, the flat conductor F is inserted in the receiving part 30A. As described above, before the flat conductor F is inserted, an interval between the pressing part 11B-4 and supporting part 12B-2 is sufficiently ensured, and therefore, the flat conductor F is easily inserted into the receiving part 30A to a predetermined position. Thereafter, as seen in FIG. 4(C), when the movable member 40 is moved toward a closed position, the regulated part 11B-3 presses the flat conductor F in a downward direction on pressing part 11B-4 in a state not contacting the regulating part 31B, and the flat conductor F receives a predetermined amount of pressure with regard to the supporting part 12B-2. Thus, the flat conductor F contacts the pressing part 11B-4 and the supporting part 12B-2, and a circuit part of the flat conductor F electrically contacts at least one of the pressing part 11B-4 or the supporting part 12B-2. In FIG. 4(C), when the pressing part 11B-4 presses the flat conductor F, the regulated part 11B-3 and regulating part 31B are in a state not contacting and leaving a gap, and there is no influence on the pressing force of the pressing part 11B-4 with regard to the flat conductor F. Furthermore, it is not required that the regulated part 11B-3 and the regulating part 31B not be in contact, and, as long as a state is ensured in which the pressing part 11B-4 has a sufficient pressing force to press the flat conductor F, the regulated part 11B-3 and regulating part 31B may even be in contact.

Second Embodiment

Figure 5:
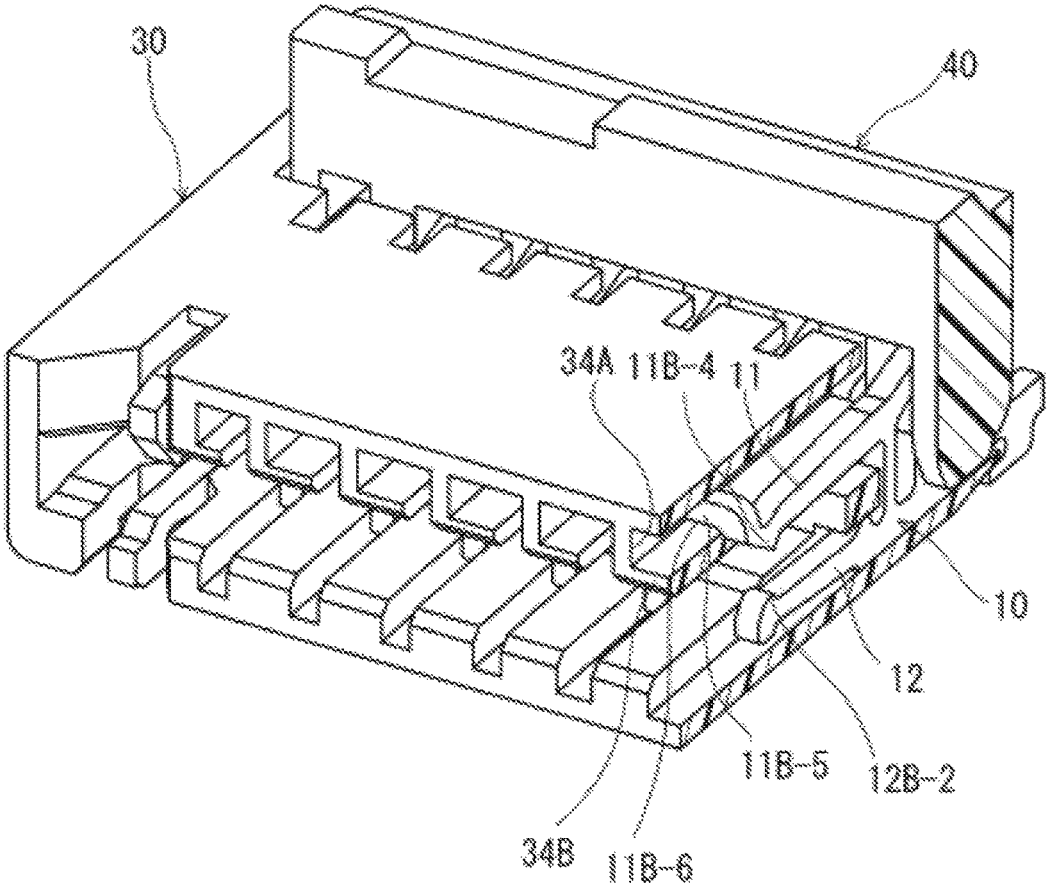
FIG. 5 illustrates a cross-sectional perspective view of a second embodiment of the present invention at a terminal position when a flat conductor is not inserted, which illustrates a state in which the movable member is in an open position.
Figure 6:
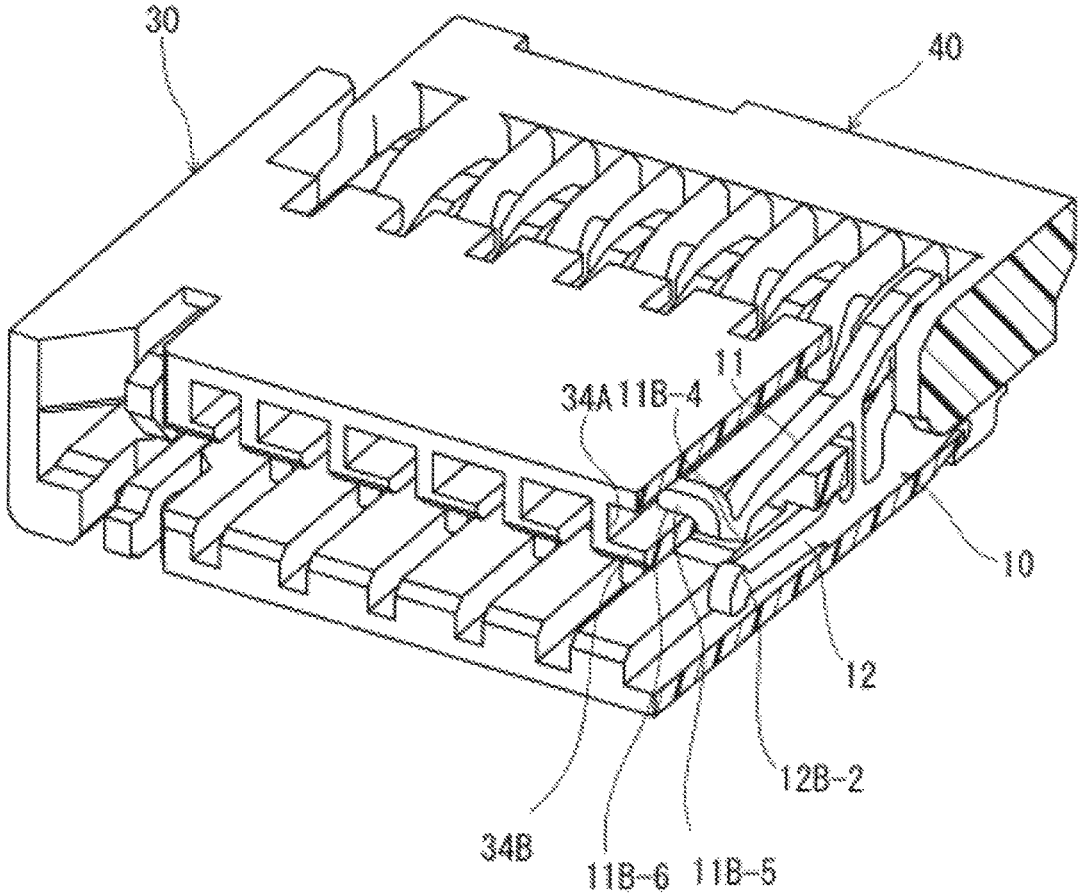
FIG. 6 illustrates a cross-sectional perspective view of a second embodiment of the present invention at a terminal position when a flat conductor is not inserted, which illustrates a state in which the movable member is in a closed position.

Next, a second embodiment of the present invention will be described based on FIG. 5 through FIG. 7. In the previous embodiment, the terminal 10 had an overall shape in which a flat surface of a metal plate was maintained, but the present embodiment is characterized in that the regulated part is formed bent in a plate thickness direction. In FIG. 5 through FIG. 7, only the regulated part of the terminal 10 and the regulating part of the housing 30 are different from the previous embodiment illustrated in FIG. 1 through FIG. 4, and other sites are the same, and therefore, in FIG. 5 through FIG. 7, the same reference codes apply to parts in common with FIG. 1 through FIG. 4, and a description thereof is omitted.

Figure 7A:
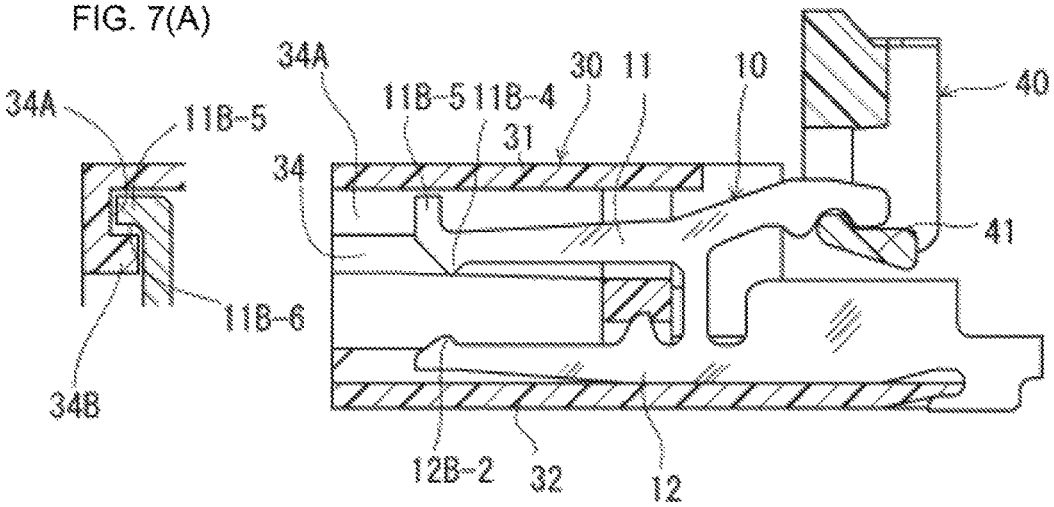
FIGS. 7(A) to 7(C) illustrate cross-sectional views of the connector in FIG. 5 in a terminal position, where
Figure 7B:
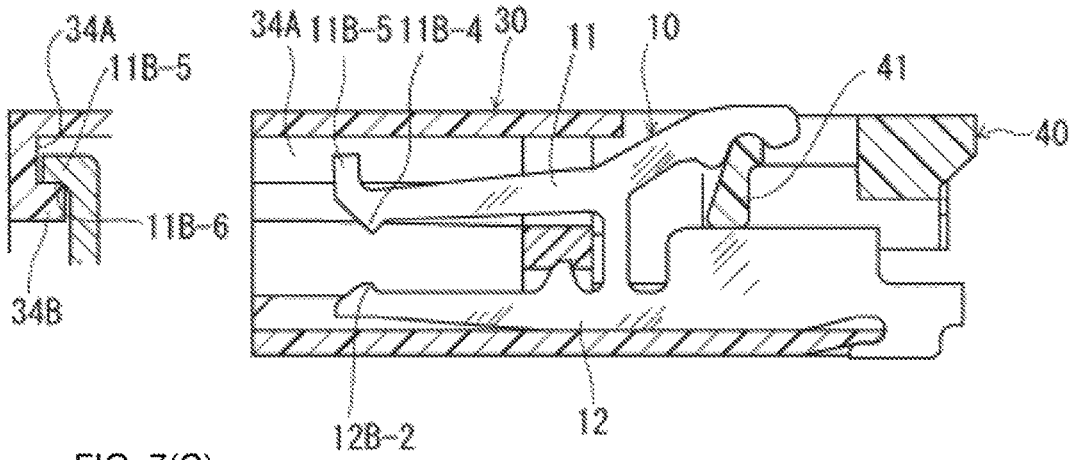
Figure 7C:
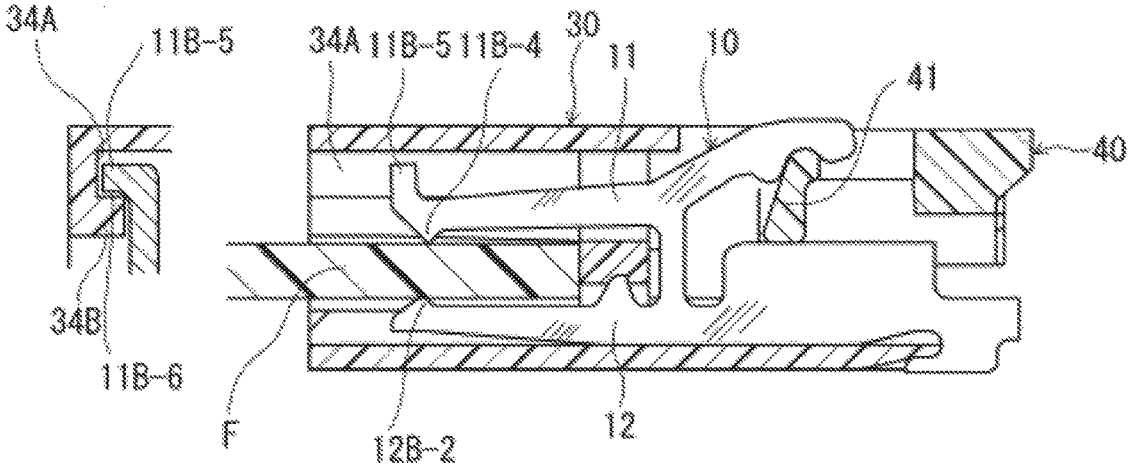

As seen in FIG. 5 and FIG. 7(A), which illustrates a state in which a movable member is in an open position when the flat conductor F (refer to FIG. 7(C)) is not inserted, the pressing arm part 11 has a portion more rearward than the pressing part 11B-4 bent laterally to form a lateral protruding part 11B-5, and a lower edge of the lateral protruding part 11B-5 is used as a regulated part 11B-6. On the other hand, in the housing 30, a through groove 34A is formed in the front and rear direction on the partition wall 34 on a side where the lateral protruding part 11B-5 is directed, and a portion forming a lower surface of the through groove 34A is formed as a regulating part 34B positioned immediately below the regulated part 11B-6 as a lateral receiving part for receiving the lateral protruding part 11B-5.

In the present embodiment as described above, when the movable member 40 is moved toward a closed position when the flat conductor F is not inserted, the regulated part 11B-6 contacts the regulating part 34B during the movement, and thus further elastic displacement of the upper rear arm part 11B of the pressing arm part 11 is regulated. The effects brought about by avoiding plastic deformation and behaviors during insertion of the flat conductor F during use due to the regulation is the same as in the previous embodiment. Therefore, at the time of use, a gap is formed between the regulated part 11B-6 and regulating part 34B and both do not contact (refer to FIG. 7(C)). Furthermore, it is not required that the regulated part 11B-6 and the regulating part 34B not be in contact, and, as long as a state is ensured in which the pressing part 11B-4 has a sufficient pressing force to press the flat conductor F, the regulated part 11B-6 and regulating part 34B may even be in contact.

Third Embodiment

Figure 8A:
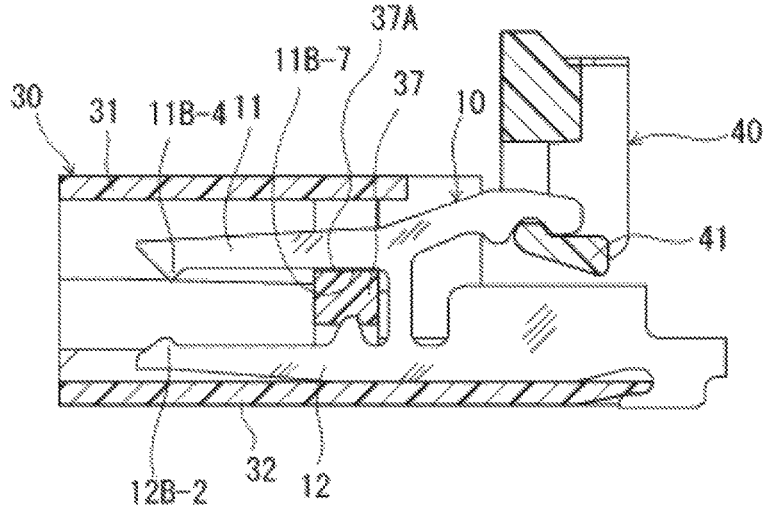
FIGS. 8(A) to 8(C) illustrate cross-sectional views of a connector of a third embodiment in a terminal position, where
Figure 8B:
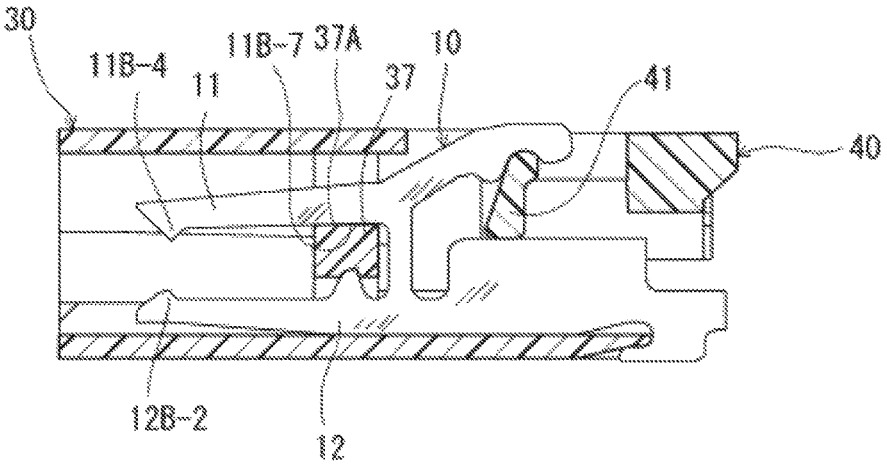
Figure 8C:
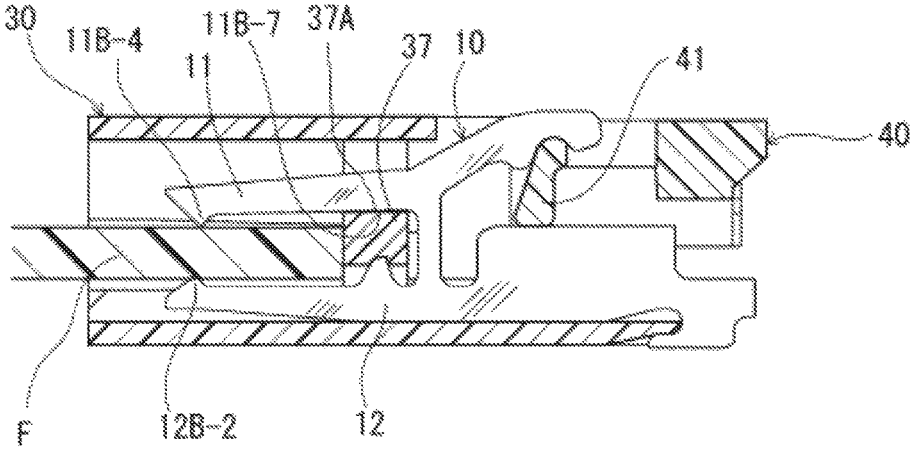

Next, a third embodiment of the present invention is described based on FIGS. 8(A) to 8(C). FIGS. 8(A), 8(B), and 8(C) illustrate a state respectively corresponding to FIGS. 4(A), 4(B), and 4(C). The present embodiment is characterized in that a regulated part is not a rear end of a terminal and is provided at an intermediate position in the front and rear direction, and when this point is excluded, the present embodiment is the same as the first embodiment illustrated in FIG. 1 through FIG. 4. Therefore, even in the present embodiment, a terminal is in a shape in which a flat surface of a metal plate is maintained, and in FIG. 8, the same reference codes apply to parts in common with FIG. 4, and a description thereof is omitted.

With the present embodiment illustrated in FIG. 8(A), in the terminal 10, the pressing part 11B-4 is positioned on a rear end of the pressing arm part 11, a rear end protruding part as the regulated part 11B-3 as illustrated in FIG. 4(A) is not provided therebehind, and a lower edge of a site near the connecting part 13 of the upper rear arm part 11B is used as a regulated part 11B-7. However, an upper surface of the island-shaped intermediate securing part 37 of the housing 30 forms an intermediate receiving part 37A as a regulating part, the intermediate receiving part 37A is immediately below the regulated part 11B-7, and a gap between the regulated parts 11B-7 is defined at a position regulating the elastic displacement to a predetermined amount. The behaviors of the regulating part and regulated part when the flat conductor F (refer to FIG. 8(C)) is not inserted and behaviors during use are as illustrated in FIGS. 8(B) and 8(C), and achieve a similar effect to the embodiments described above.

DESCRIPTION OF THE REFERENCE CODES

1 Connector for a flat conductor
10 Terminal
11 Pressing arm part
11A-1 Pressure receiving part
11B-2 Regulated part (rear end protruding part)
11B-3 Pressing part
11B-5 Lateral protruding part
11B-6 Regulated part
11B-7 Regulated part
12 Supporting arm part
30 Housing
30A Receiving part
31B Regulating part (rear end receiving part)
34B Regulating part (lateral receiving part)
37A Regulating part (intermediate receiving part)
40 Movable member
41 Cam part
F Flat conductor

What is claimed is:

1. An electrical connector for a flat conductor, comprising:

a metal plate terminal;

a housing holding the metal plate terminal at a predetermined interval in a direction orthogonal to a plate surface thereof; and a movable member at a front end side of the electrical connector configured to move between an open position that enables insertion of a flat conductor facing frontward toward a receiving part formed on the housing and a closed position that presses the flat conductor at the terminal, wherein the metal plate terminal comprises a pressing arm part extending such that an insertion-and-removal direction of the flat conductor is in a longitudinal direction, and a supporting arm part connected to the pressing arm part by a connecting part that extends in the longitudinal direction; the pressing arm part comprises:

a pressing part for pressing one surface of the flat conductor on a rear end side, wherein the rear end side of the electrical conductor is an insertion side of the flat conductor, and a pressure receiving part that receives a force from a cam part at a more frontward position than the pressing part; the pressing arm part receives a force from the cam part, and the pressing arm part causes elastic displacement inside the same surface as the terminal plate surface, such that the flat conductor is pressed by the pressing part, and wherein a regulating part that regulates elastic displacement on a more rear end side than a connecting part of the pressing arm part is provided on at least one of the terminal pressing arm part and the housing or a member attached to the housing;

wherein the pressing arm part comprises a protruding part that floats with respect to the regulating part when the movable member is configured in the open position, and causes the pressing arm part and the regulating part to contact when the movable member is configured in the closed position.

2. The electrical connector for a flat conductor according to claim 1, wherein the regulating part is provided at a position where the elastic displacement of the pressing arm part due to movement of the movable member when the flat conductor is not inserted is smaller than the maximum elastic displacement of the pressing part when the movable member is provided at a closed position if regulation is not received by the regulating part, and is larger than the elastic displacement at a contact start position with the flat conductor of the pressing part when the movable member during insertion into the receiving part of the flat conductor is moving toward a closed position.

3. The electrical connector for a flat conductor according to claim 1, wherein the regulating part is formed on a housing or a member attached thereto, and wherein the protrusion part is a regulated part that can be brought into contact with the regulating part.

4. The electrical connector for a flat conductor according to claim 3, wherein the regulated part is positioned on a same surface as the plate surface and formed as a rear end protruding part protruding more rearward than the pressing part of the pressing arm part, and the regulating part formed as a rear end receiving part protruding frontward to a position below the rear end protruding part of the pressing arm part at a rear end of the housing.

5. The electrical connector for a flat conductor according to claim 3, wherein the regulated part is formed as a lateral protruding part that bends laterally and is more rearward from the plate surface of the terminal to the pressing part, and the regulating part formed as a lateral receiving part positioned below a lateral protruding part of the pressing arm part at a rear end of the housing.

6. The electrical connector for a flat conductor according to claim 3, wherein the regulated part is formed at a lower edge of the pressing arm part at an intermediate position near the connecting part in the longitudinal direction of the pressing arm part, and has the regulating part protruding laterally to below the regulated part at a lateral position of the terminal and formed as an intermediate receiving part receiving the regulating part.

* * * * *